US006942448B1

(12) United States Patent
Pemberton

(10) Patent No.: US 6,942,448 B1
(45) Date of Patent: Sep. 13, 2005

(54) PUMP

(75) Inventor: Steve Pemberton, Gautier, MS (US)

(73) Assignee: Fast Flow LLC, Gautier, MS (US)

( * ) Notice: Subject to any disclaimer, the term of this patent is extended or adjusted under 35 U.S.C. 154(b) by 18 days.

(21) Appl. No.: 10/672,175

(22) Filed: Sep. 26, 2003

(51) Int. Cl.[7] ..... F01D 3/02
(52) U.S. Cl. ..... 415/102; 200/214.1; 417/423.3
(58) Field of Search ..... 415/102, 206, 415/214.1, 200; 417/423.3

(56) References Cited

U.S. PATENT DOCUMENTS 632,572 A * 9/1899 Ivens ..... 415/97
885,867 A * 4/1908 Salzer ..... 415/97
3,160,107 A * 12/1964 Ross ..... 415/214.1
3,246,605 A * 4/1966 Fisher ..... 415/102
3,935,833 A * 2/1976 Onal ..... 415/203
4,247,250 A * 1/1981 Lipe et al. ..... 415/215.1
4,518,311 A * 5/1985 Dernedde et al. ..... 415/102
4,688,987 A * 8/1987 Ericson et al. ..... 415/97
4,786,239 A * 11/1988 Eberhardt ..... 417/238
5,980,199 A * 11/1999 Godichon ..... 415/102

* cited by examiner

*Primary Examiner*—Edward K. Look
*Assistant Examiner*—Igor Kershteyn

(57) ABSTRACT

A centrifugal pump is provided for use with fluids, gases, and solids in connection with a drive shaft and a motor. The pump has a housing and a sloped impeller mounted on the shaft within the housing. The housing has opposing inlets on each side of the impeller and a discharge outlet. The impeller can be constructed as split through its center with an associated split housing or being an integral part.

13 Claims, 4 Drawing Sheets

PUMP

FIELD OF THE INVENTION

This invention is generally directed to centrifugal pumps having rotatably driven impellers mounted within a housing so as to create a fluid flow through such housing between a pair of opposite inlets and an outlet therein. More particularly, the invention provides a centrifugal pump which includes an impeller that attaches to a drive shaft or a motor and is rotatably disposed within the housing. Opposing fluid inlets are created between two opposite sides of the housing from which uniflow fluids are directed to a fluid outlet also formed in the housing.

BACKGROUND OF THE INVENTION

U.S. Pat. No. 4,688,987 to Ericson et al discloses a centrifugal pump having a split impeller which is mounted directly to an existing drive shaft. The inner surfaces of the hub portions of the split impeller are knurled or otherwise provided with ridges as to bite or lock the hub against the drive shaft when the two portions of the impeller are clutched together.

This prior centrifugal pump is particularly adapted for use in the engine compartment or hull of a marine vessel wherein the impeller is attached for rotation with the drive shaft, such as a propeller drive shaft, such as a propeller drive shaft, and wherein the pump housing is mounted so as to be in a surrounding and spaced relationship to the impeller blades and drive shaft. The impeller is freely rotatable in order to pump fumes, solids, or fluids through annular intake openings in the pump housing and deliver the same through an outlet formed in the pump housing.

U.S. Pat. No. 5,051,071 to Haentjens discloses a split impeller centrifugal pump for mounting on an existing drive shaft. The pump has opposed annular inlets. The pump does not contain vanes but grooves and air ducts.

It is an object of this invention to provide a self priming centrifugal pumping apparatus which couples to a drive shaft in an environment wherein liquids, gases, or solids may be encountered and wherein the pump is structured so that the impeller is not journaled or directly mounted to the pump housing. In this manner, no heat is generated during the rotation of the impeller by friction between the impeller and the housing as is the case in a pump which the impeller is directly carried by the pump housing.

It is also an object of the present invention to provide a centrifugal pump apparatus which is coupled between the engine and the drive shaft to provide a pumping apparatus which does not require the lubrication and maintenance associated with conventional centrifugal pumps.

It is another object of the invention to provide an improved self priming pump for removing liquid from a vessel or container that is operated from nearby or remote areas.

SUMMARY OF THE INVENTION

According to the present invention there is provided a self priming centrifugal pump apparatus which pumps flowable materials, runs wet or dry, and pumps forward or in reverse.

The apparatus comprises a drive shaft, an engine or motor for driving said drive shaft, a housing having front and rear walls, peripheral side walls and a pair of opposing fluid inlet opening which surround the power source and provides equal pressure from both sides on an impeller. An impeller which is sloped on two sides forms a coupling of the motor with the drive shaft within and in spaced relationship with the housing. The slope expedites movement of the flowable material outward to the tapered vanes. Accordingly, the impeller and housing cooperate to discharge different types of materials in response to the rotation of the drive shaft.

According to one embodiment of the invention, the housing comprises front and rear wall portions, a pair of opposing fluid inlet openings in said front and rear walls of said housing providing equal pressure from both sides on the impeller means. The housing is provided with two sections in which each is provided with a fluid inlet opening and a central opening for a drive shaft in at least one section of the housing to provide for a drive shaft.

The impeller may be adapted to be connected to a motor and a drive shaft or it can connect directly to a motor. The pump may be used by itself to carry fluid materials such as solids and fluid from a vessel or container or body of water or can be used in connection with a drive shaft of a propeller for a boat.

According to another embodiment of the invention, there is provided a fluid immersible self-priming discharge pump for removing a fluid such as water and sludge from a container or vessel or body of water. The discharge pump comprises a motor, a housing associated with the motor having at least two opposing sides of the impeller. A drive shaft is within the housing and operatively connected for rotation by the motor. An impeller associated with the drive shaft and rotatable within the housing so as to draw fluid under equal pressure into the housing through the inlet openings in the housing and pass it along the sloped surfaces so as to discharge the fluid through the outlet openings by means of impeller blades.

According to another embodiment of the invention, there is provided a fluid immersible self priming discharge pump for removing a flowable material or fluid such as water from a container or vessel. The discharge pump comprises a hydraulic motor, a housing associated with the motor having at least two opposite fluid inlet openings which create substantially equal pressure on opposing sides of the impeller. A drive shaft is within the housing and operatively connected for rotation by the motor. An impeller means is associated with the drive shaft and rotatable within the housing so as to draw fluid under equal pressure into the housing through the inlet openings and pass it along the sloped surface so as to discharge the fluid through the outlet openings by means of the impeller blades. A hose or nozzle is associated with the outlet opening to carry the discharge fluid away. The means for activating the motor can be in the form of a hydraulic pump which is located at a separate area, for example, outside of the vessel or container or on another boat.

In accordance with a further embodiment the pump is provided with a split impeller and a split housing, each with connecting means so as to attach the pump to an extinguishing drive shaft without disassembling the shaft structure.

DESCRIPTION OF THE PREFERRED EMBODIMENTS

A more complete understanding of the invention will be had by referring to the following description and claims of a preferred embodiment, taken in conjunction with the accompanying drawings, wherein like reference members refer to similar parts throughout the several views.

Figure 1:
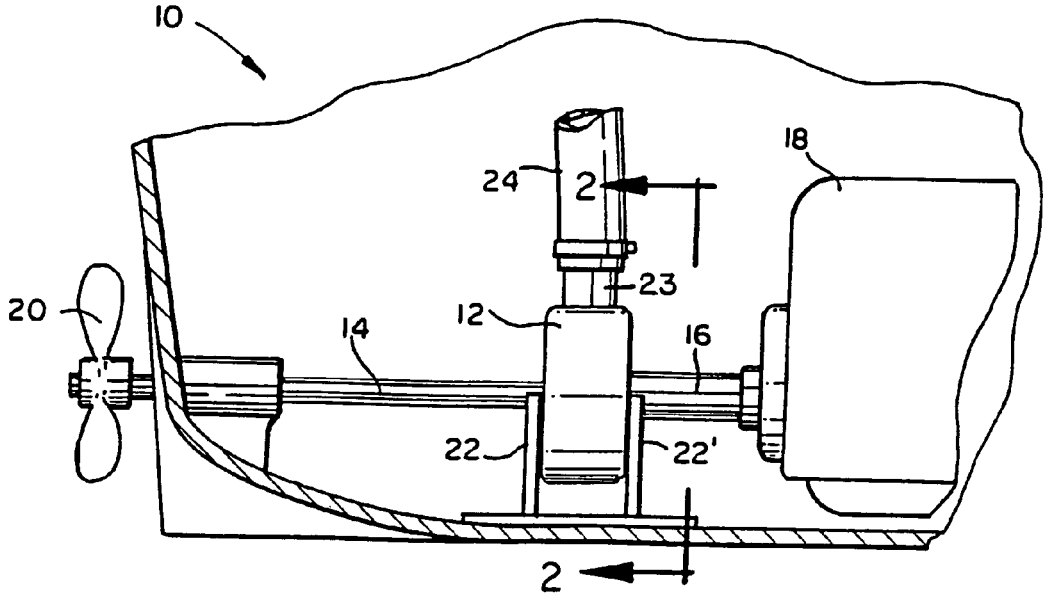
FIG. 1 illustrates the mounting of the pump of the invention with the propeller drive shaft and transom of an inboard motor.
Figure 2:
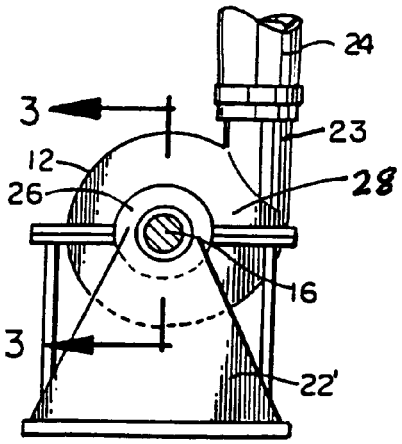
FIG. 2 is an enlarged front plan view of the pump housing taken along lines 2—2 of FIG. 1.

With continued references to FIGS. 1 and 2 of the drawings, the centrifugal pump 2 according to one embodiment of the present invention, the pump is shown as it is mounted in relationship to a propeller drive shaft 16 within the hull of an inboard motorboat 10 from the propeller 20 through a transom, to the motor or engine 18. A suitable of stuffing box 22, 22' can be mounted so as to rotatably support the drive shaft 16 and pump 12. The discharge outlet 23 is attached to a hose 24. It should be noted that although the centrifugal pump 12 is being described for use with the propeller drive shaft of a conventional inboard motorboat 10, the pump 12 could be used in other environments. In addition, although only a single pump 12 is shown in the preferred embodiment, there may be occasions when two or more pumps would be used in the same environment such as a boat having twin screws driven by a pair of parallel drive shafts.

Figure 3:
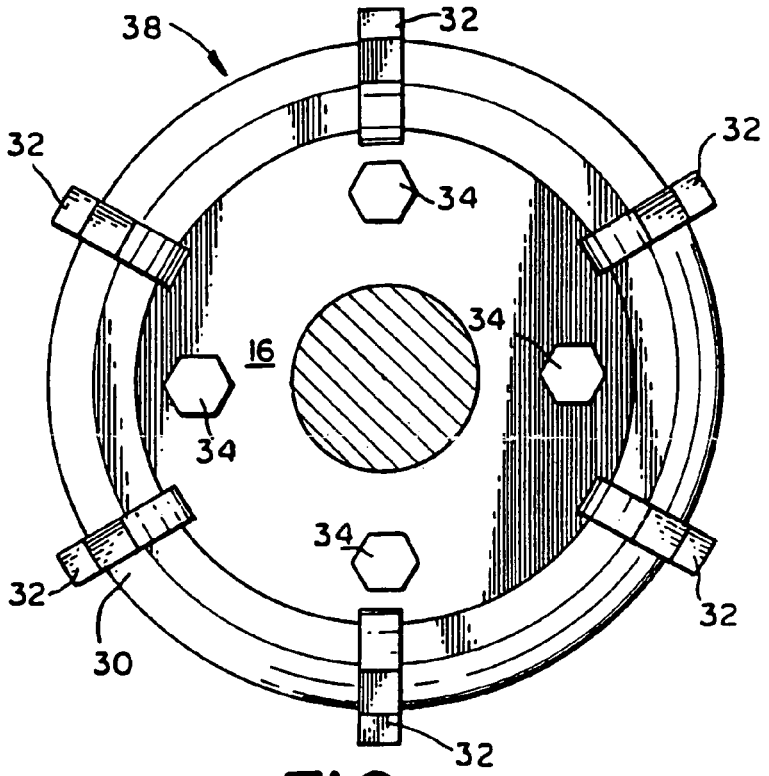
FIG. 3 is a side view of an integral impeller of the invention.

As seen in FIG. 3 the impeller 38 comprises blade members 32 about its periphery. Bolts or other fastening means 34 connect the front side of a clam-shell like impeller to the back side (not shown). However, the impeller 38 may be solid or joined at its periphery by welding so that the bolts 34 are not required. A slope of 30 to 45° on the impeller is generally suitable for moving the flowable materials to the blades 32.

Figure 4:
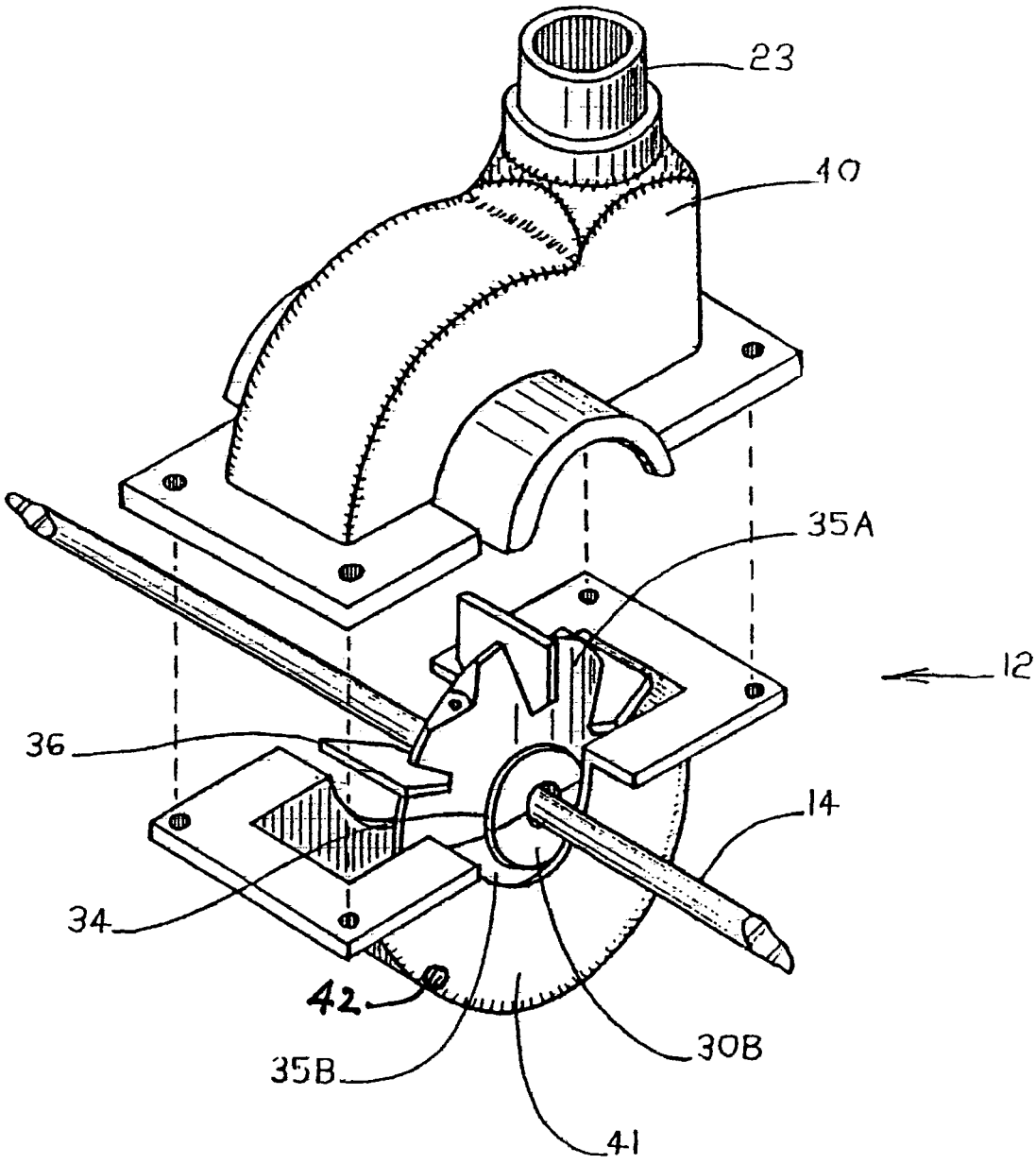
FIG. 4 is an exploded view of the split impeller pump of the invention.

As shown in FIG. 4 the pump 12 is constructed of a pair of split hemispherically shaped adapters 30A, 30B having lips or ridges 34. An impeller composed of split halves 35A, 35B and blades 36, are joined together by bolts 36 on the split adapters 30A, 30B so as to sit within the lips 34. The bolts 36 go through holes 37 in the impeller halves 30A, 30B into threaded holes 37, 38 to secure the impeller to the adapter. The top portion 40 of the split housing has the discharge opening 23 to which a hose 24 can be attached to carry away the discharge. The top portion 40 can be attached permanently or removably to the bottom portion 41 of the housing. The bottom portion 41 is provided with a drainage port 42. The assembled pump has an inlet opening 43 on both sides of the impeller 36. When the housing is assembled it comprises the top, front, rear, and sidewalls of the pump 12.

Figure 5:
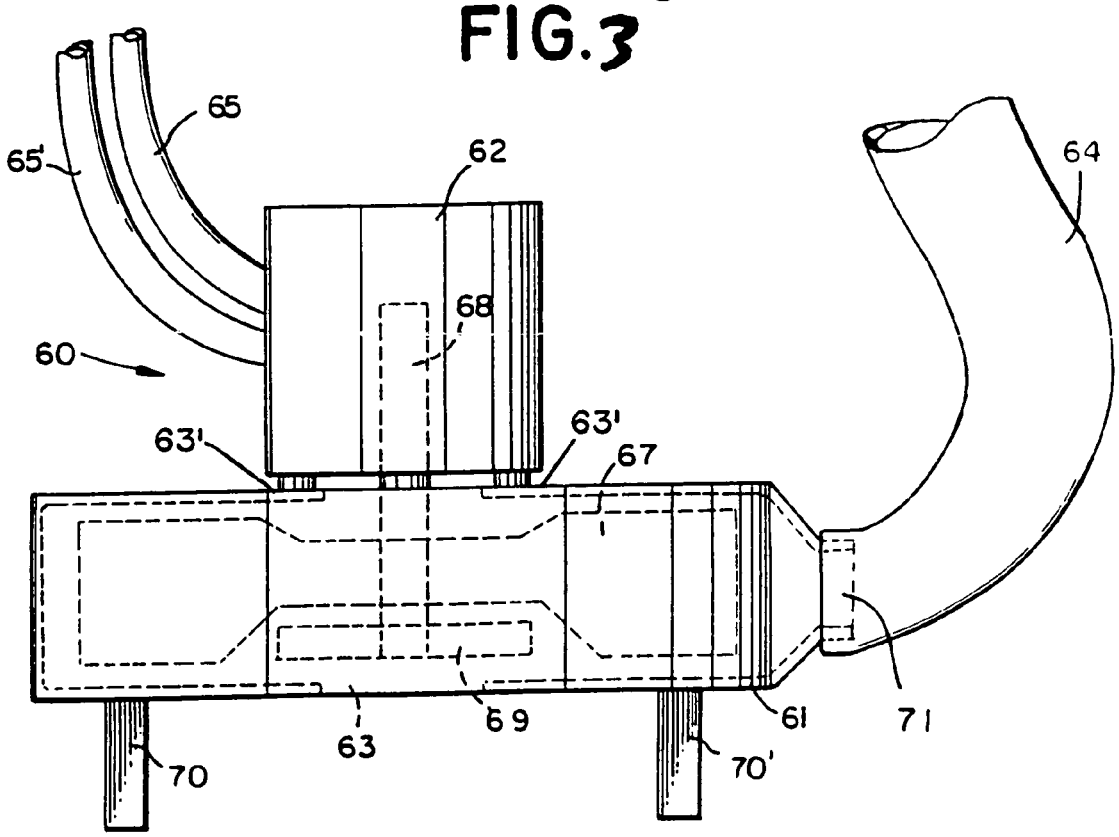
FIG. 5 illustrates a fluid immersible pump of the invention.

In FIG. 5 there is illustrated a fluid immersible pump 60 which can be used as a bilge pump that operates from a remove area, for example, another boat which provides a source of power. Pump 60 comprises a pump housing 61 in which an impeller 67 is mounted for rotation by a drive shaft 67. The drive shaft 68 is operatively connected to a hydraulic motor 62 that it is operated by a hydraulic pump (not shown) through hydraulic lines 65, 65'.

The housing 61 is provided with two or more fluid intake openings 63, 63' and a discharge opening 71 to which there is attached a discharge hose or nozzle 64. The water enters so that there is equal pressure from both sides on the impeller 67 whereby the pump is self priming.

Fluid openings 63' are provided on one side of the impeller 67 and a fluid opening 63 is provided on the other side of the impeller 67 so as to create equal pressure and to be self priming.

The discharge opening 71 can be tangential as shown in FIG. 2, but advantageously it is horizontally aligned with the impeller 67 as seen in FIG. 5. Optionally, the housing 61 may have a stand such as foot 70 and 70'. Also, the interior of the housing 61 may contain a screen 72 to prevent intake of large objects which may damage the impeller 67.

In operation, the motor 62 rotates the impeller 67 which draws a fluid, for example, water, through the inlets 63, 63' and into pump 60 that it is carried outwardly along the sloped impeller surface and propelled by the impeller blades through the discharge hose 64. The hydraulic lines 65 and 65' may be connected to a hydraulic pump on a vessel which is remote from the area of operation.

The construction of the impeller of the bilge pump may be in accordance with the impeller shown in FIG. 3.

Figure 6:
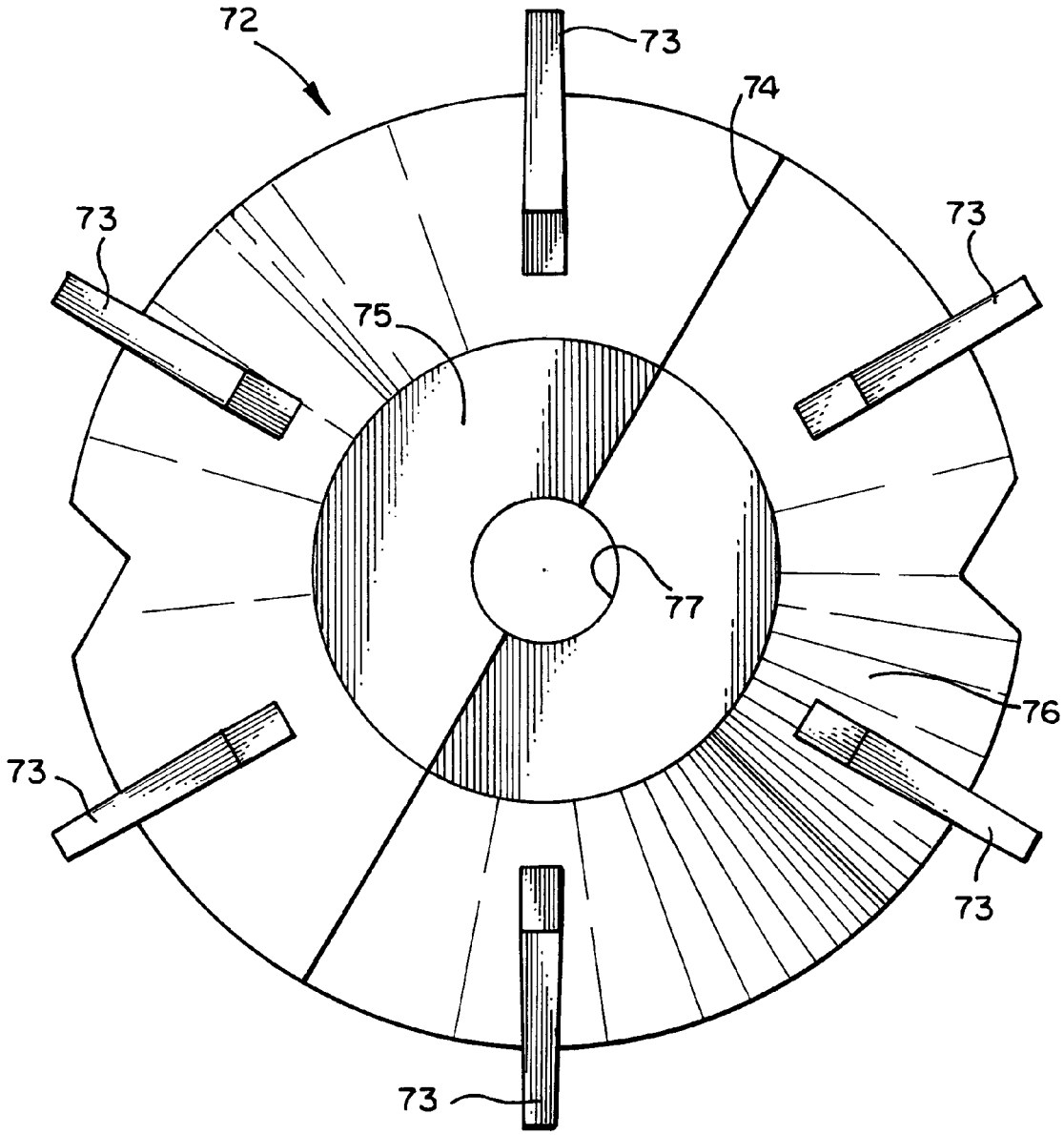
FIG. 6 illustrates a front view of a further impeller of the invention.

As seen in FIG. 6 there is an impeller 72 which is split along 74. The impeller 72 is provided on each side with sloping vanes or blades 74. Preferably the blades 74 diminish in thickness as they extend outward. The blades 74 are found on the sloped portion 76 of the impeller 72. The impeller 72 has on both sides a slope and a flat portion 79 which is formed as a result of grinding or shearing so as to balance the impeller.

The impeller 72 is provided with an opening or channel 77 which may be keyed for use on a drive shaft (not shown). The impeller may be bolted together (not shown) when placed on a drive shaft or may be welded along line 74 to make it integral.

The outlet of the pumps may be provided with a male pipe thread nipples (not shown) with cam-lock safety fittings so as to meet OSHA requirements.

A typical pump having a water discharge capacity to 15 gallons per second is provided with an 8 inch impeller having a 300 slope, a housing with a diameter of about 10½ inches, a width of about 3¼ inches. The NPT discharge is about 3 inches and the solid handling capacity is to about ⅞ inch. No seals are required.

In the larger sized remote pumps where there is a discharge opening of about 16 inches and an intake opening of about 10 inches, the sloped impeller is about 26 inches in diameter and is provided with impeller blades or paddles of about 5 inches in length.

The impeller can be constructed using aluminum, and/or injected molded plastic, or glass reinforced plastic. The impeller, when removed from the mold is generally clean and does not require any machining, just the removal of the fill spout and the drilling and tapping of one hole for the threaded bolt. The finish of the impeller when removed from the mold has a high quality lustrous finish.

Depending on its use, the impeller may be a solid integral piece, comprised of two parts joined at its periphery in a clam-shell like fashion and hollow in the interior with a channel through its center for a drive shaft. Also, the impeller may be split into two halves for ease in installing on a drive shaft.

The housing is generally split in two halves so as to enclose the impeller. However, the housing can have openings on opposite sides along the drive shaft for the inlet of the material. The openings can comprise slits or connecting elements for attachment to hoses.

Although the foregoing invention has been described in some detail by way of illustration and example for purposes of clarity of understanding, it will be obvious that certain changes and modifications may be practiced within the scope of the appended claims.

What is claimed is:

1. A self-priming immersible centrifugal pump apparatus for removing liquid and solids which pumps forward or in reverse comprising:

a) a housing having a front wall and a rear wall, a discharge outlet opening in a top portion and opposing inlet means on opposite sides of the housing which creates equal pressure from both sides on an impeller, b) said impeller within and in spaced relationship with said housing, said impeller having a slope on both sides of about 30 to 45 degrees and outwardly extending blades along its periphery for movement of flowable material outward to the discharge outlet, c) a drive shaft mounted in said housing and connectable to a motor means, said impeller and housing cooperating to discharge flowable material through said discharge outlet opening in response to rotation of said impeller.

2. The centrifugal pump of claim 1 wherein said housing has a pair of aligned fluid inlet means about the drive shaft.

3. The centrifugal pump of claim 1 wherein said drive shaft extends through a fluid inlet opening.

4. The centrifugal pump of claim 1 wherein said drive shaft includes a propeller.

5. The centrifugal pump of claim 1 including a motor associated with said housing and said drive shaft within said housing being operatively connected for rotation by said motor, and means for activating said motor.

6. The centrifugal pump of claim 1 wherein said impeller comprises plastic material.

7. The centrifugal pump of claim 1 comprising a split impeller and a split housing.

8. The centrifugal pump of claim 1 in combination with a drive shaft hydraulic motor.

9. A self-priming immersible centrifugal pump for use with liquids and solids which pumps forward or in reverse comprising a drive shaft, a motor means for driving said drive shaft, a housing having a sloped impeller mounting on said shaft in spaced relationship within said housing, inlet means in said housing on opposite sides of said housing and said impeller about the shaft so that there is equal pressure on both sides of the impeller, and outlet means for discharging liquids and solids in response to rotation of said impeller, said pump having a discharge capacity of at least 15 gallons per second.

10. The centrifugal pump apparatus of claim 9 wherein said housing comprises front, rear and side wall portions, a pair of aligned fluid inlet opening in said front and rear walls of said housing, each of said fluid inlet openings being of a greater dimension than the cross sectional dimension of the drive shaft.

11. The centrifugal pump apparatus of claim 9 wherein said drive shaft extends through said fluid inlet openings in spaced non-contacting relationship to said housing so that fluids entering said housing passes around said drive shaft substantially equally on both sides of said impeller, across the sloped surface of the impeller means and through said outlet means, and in which said outlet means is formed in said side wall of said housing and includes a nozzle means for creating a channel which extends outwardly of said housing generally tangentially with respect to said housing.

12. The centrifugal pump apparatus of claim 9 wherein said drive shaft is coupled to one side of said impeller and said motor means is coupled on the other side of said impeller within said housing.

13. A fluid immersible self-priming discharge pump which pumps forward or in reverse comprising a hydraulic motor, a housing associated with said motor, said housing having opposing fluid inlet openings and a fluid discharge opening, a drive shaft within said housing operatively connected for rotation by said motor, an impeller means associated with said drive shaft and rotatable within said housing so as to draw fluid into said housing through said inlet openings, said impeller means being sloped on both sides and having blades along its outward edge for discharging fluid through said discharge opening; said inlet openings being on both sides of said impeller means and creating substantially equal pressure on both sides of said impeller means, and means separate from said motor for activating said motor when said housing is immersed in a fluid, said impeller having on both sides a slope and a flat portion which is formed to balance said impeller.

* * * * *